US012419385B2

(12) United States Patent
Luu et al.

(10) Patent No.: US 12,419,385 B2
(45) Date of Patent: Sep. 23, 2025

(54) ARTICLE OF FOOTWEAR INCLUDING AN INTEGRATED STABILITY MEMBER

(71) Applicant: Nike, Inc., Beaverton, OR (US)

(72) Inventors: Vu Luu, Beaverton, OR (US); Kelly A. O'Connor, Beaverton, OR (US); Evan Perkins, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/397,727

(22) Filed: Dec. 27, 2023

(65) Prior Publication Data

US 2024/0215681 A1 Jul. 4, 2024

Related U.S. Application Data

(60) Provisional application No. 63/477,399, filed on Dec. 28, 2022.

(51) Int. Cl.

| | |
|---|---|
| ***A43B 23/08*** | (2006.01) |
| ***A43B 7/24*** | (2006.01) |
| ***A43B 13/12*** | (2006.01) |
| ***A43B 13/18*** | (2006.01) |

(52) U.S. Cl.

CPC ..... *A43B 13/18* (2013.01); *A43B 7/24* (2013.01); *A43B 13/12* (2013.01); *A43B 23/08* (2013.01)

(58) Field of Classification Search

CPC ..... A43B 13/12; A43B 13/14; A43B 7/1495; A43B 7/24; A43B 23/08

USPC ..... 36/25 R

See application file for complete search history.

(56) References Cited

U.S. PATENT DOCUMENTS

| | | | | | |
|---|---|---|---|---|---|
| 3,028,689 | A * | 4/1962 | Dassler | A43B 5/06 | 36/129 |
| 4,866,861 | A * | 9/1989 | Noone | A43B 5/001 | 36/134 |
| 4,947,560 | A * | 8/1990 | Fuerst | A43B 23/08 | 36/114 |
| 5,077,915 | A * | 1/1992 | Gross | A43B 13/12 | 36/31 |
| 5,396,675 | A * | 3/1995 | Vincent | B29D 35/122 | 36/114 |
| 5,465,509 | A * | 11/1995 | Fuerst | A43B 5/00 | 36/114 |
| 6,000,148 | A * | 12/1999 | Cretinon | A43B 7/14 | 36/88 |

(Continued)

FOREIGN PATENT DOCUMENTS

| | | | |
|---|---|---|---|
| DE | 102021107190 | A1 | 11/2021 |
| WO | 2021211247 | A1 | 10/2021 |

OTHER PUBLICATIONS

International Search Report and Written Opinion, PCT/US2023/086062, mailed Mar. 28, 2024. (pp. 11).

*Primary Examiner* — Marie D Bays

(74) *Attorney, Agent, or Firm* — Bookoff McAndrews, PLLC

(57) ABSTRACT

A sole structure having an outsole. The outsole having a forefoot region; a mid-foot region; a heel region; an outsole base having an upper surface and a bottom surface; a first stabilization element extending from the outsole base past the upper surface, in a direction from the bottom surface towards the upper surface; and a second stabilization element extending from the outsole base past the upper surface, in the direction from the bottom surface towards the upper surface.

20 Claims, 14 Drawing Sheets

(56) References Cited

U.S. PATENT DOCUMENTS 6,401,366 B2 * 6/2002 Foxen ..... A43B 7/1495 36/102
7,299,567 B2 * 11/2007 Berend ..... A43B 23/087 36/108
7,647,709 B2 * 1/2010 Reilly ..... A43B 23/17 36/107
8,327,560 B2 * 12/2012 Berend ..... A43B 7/1425 36/132
2002/0050078 A1 * 5/2002 Dietrich ..... A43B 13/14 36/31
2003/0070322 A1 * 4/2003 Masseron ..... A43B 21/26 36/114
2005/0278979 A1 * 12/2005 Bramani ..... A43B 13/26 36/15
2005/0278980 A1 * 12/2005 Berend ..... A43B 7/143 36/103
2006/0277798 A1 * 12/2006 Reilly ..... A43B 7/144 36/108
2007/0277401 A1 * 12/2007 Young-Chul ..... A43B 13/186 36/28
2007/0289161 A1 * 12/2007 Gerber ..... A43B 3/0047 36/12
2009/0260259 A1 * 10/2009 Berend ..... A43B 7/1435 36/35 B
2011/0113650 A1 * 5/2011 Hurd ..... A43B 7/20 36/107
2015/0143720 A1 * 5/2015 Avar ..... A43B 23/042 36/107
2015/0342300 A1 * 12/2015 Cin ..... A43B 13/127 36/103
2018/0368509 A1 * 12/2018 Cook ..... A43B 7/141
2020/0170335 A1 * 6/2020 Horvath ..... A43B 3/0047
2021/0186144 A1 * 6/2021 Truelsen ..... A43B 7/142
2021/0186150 A1 * 6/2021 Truelsen ..... A43B 13/181
2021/0212410 A1 7/2021 Hatfield et al.
2021/0259356 A1 8/2021 Maselino et al.
2021/0361028 A1 * 11/2021 Ishikawa ..... A43B 7/142
2022/0079284 A1 * 3/2022 Cooper ..... A43B 13/188

* cited by examiner

ARTICLE OF FOOTWEAR INCLUDING AN INTEGRATED STABILITY MEMBER

CROSS-REFERENCE TO RELATED APPLICATION(S)

This application claims priority to U.S. Provisional Application No. 63/477,399, filed Dec. 28, 2022, the entirety of which is incorporated herein by reference.

FIELD

The present disclosure relates generally to articles of footwear including sole structures and more particularly to outsole structures incorporating multiple stabilization elements and midsole structures incorporating geometric features (e.g., detents) that correspond to the multiple stabilization elements.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outer sole ("outsole") that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
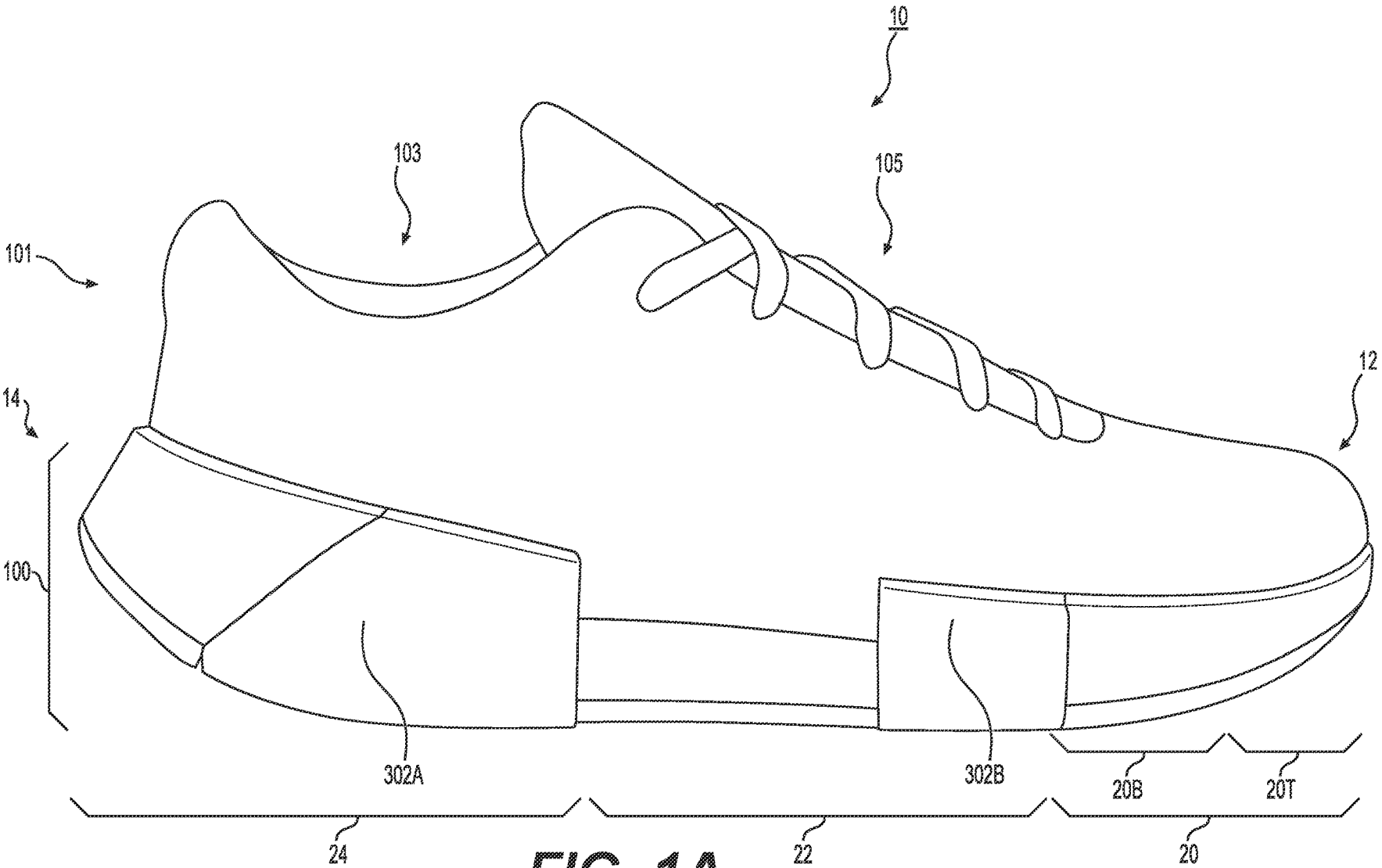
FIG. 1A is a lateral view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

Article of Footwear

Figure 1B:
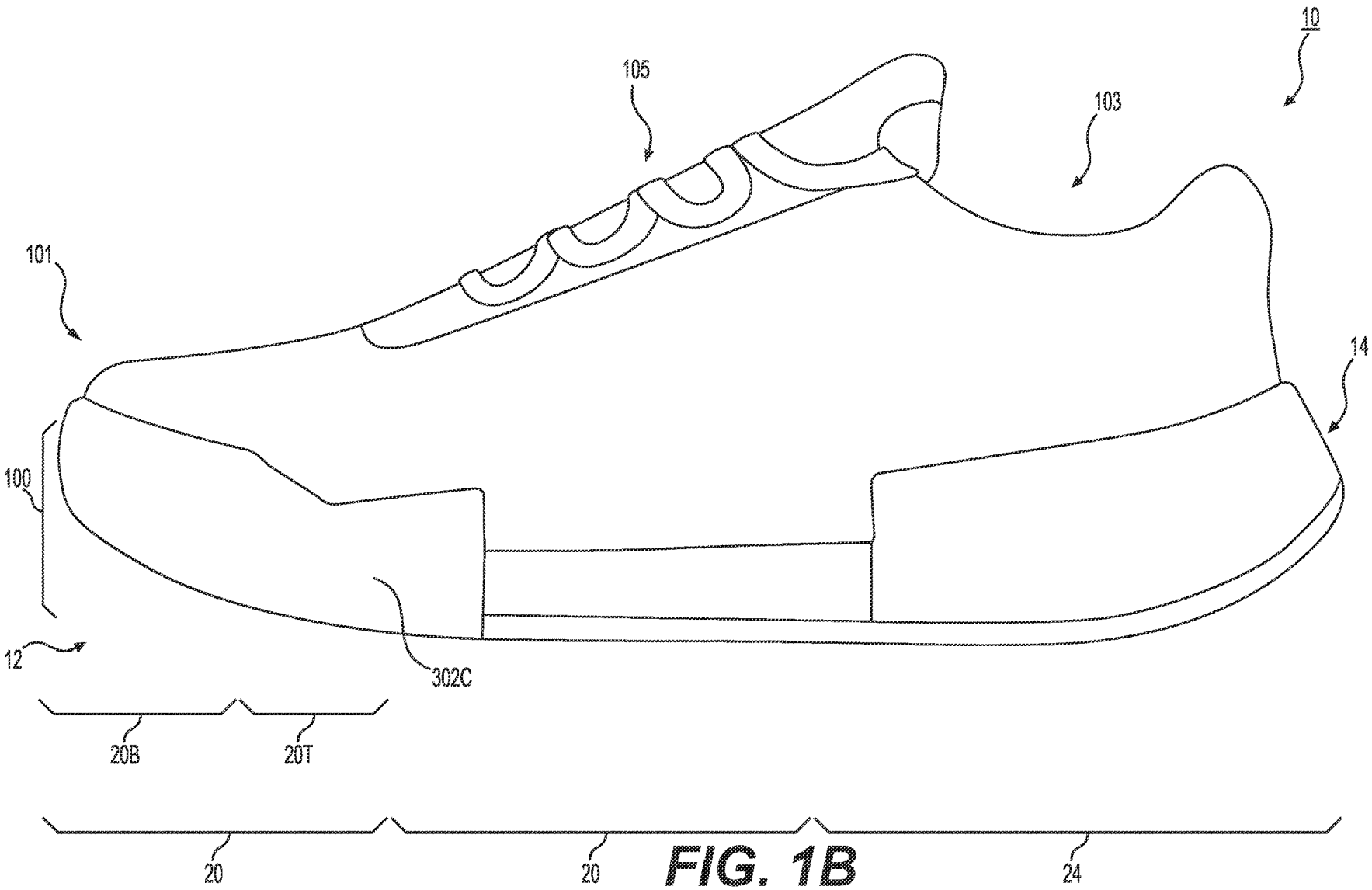
FIG. 1B is a medial view of the article of the footwear of FIG. 1A.
Figure 1C:
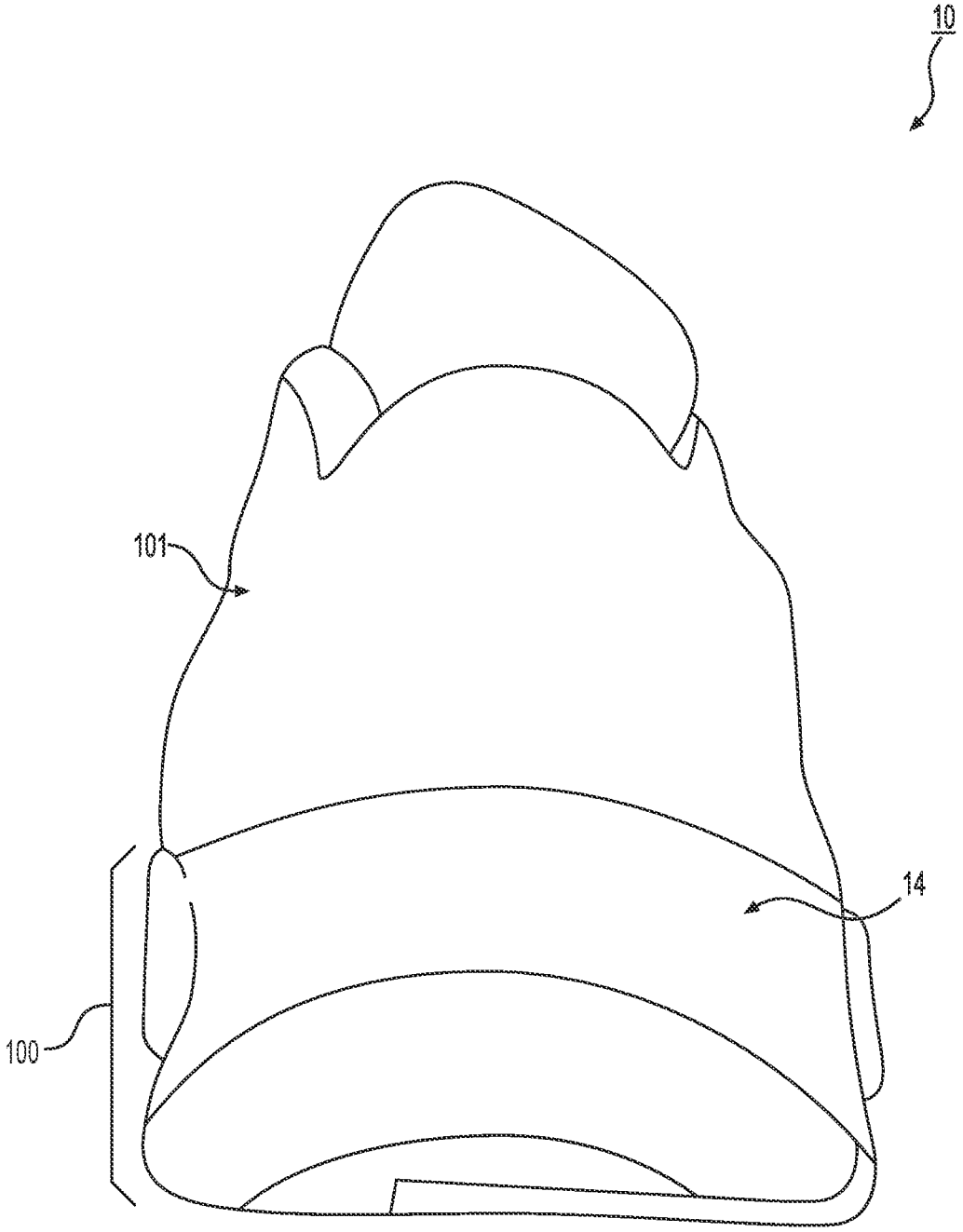
FIG. 1C is a back view of the article of the footwear of FIG. 1A.
Figure 1D:
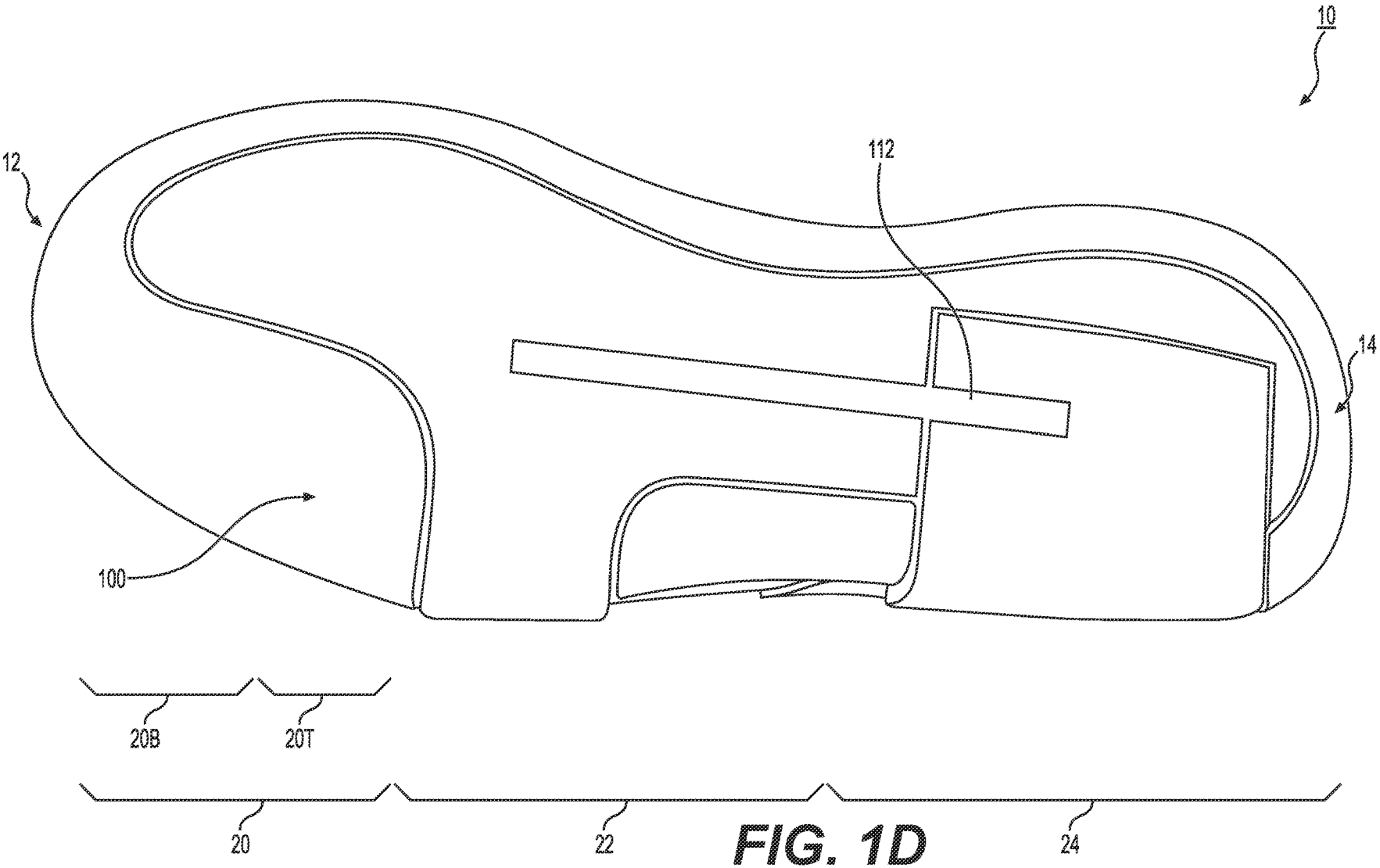
FIG. 1D is a bottom view of the article of the footwear of FIG. 1A.

Referring to FIGS. 1A-1D, an article of footwear 10 includes a sole structure 100 and an upper 101. FIG. 1A shows a lateral view of footwear 10, FIG. 1B shows a medial view of footwear 10, FIG. 1C shows a back view of footwear 10, and FIG. 1D shows a bottom view of footwear 10. Generally, the sole structure 100 is configured to provide characteristics of cushioning, support, and responsiveness to the article of footwear 10.

Footwear 10 may include an anterior end 12 associated with a forward-most point of the article of footwear 10, and a posterior end 14 corresponding to a rearward-most point of footwear 10.

Footwear 10 may be divided into one or more regions. The regions may include a forefoot region 20, a mid-foot region 22, and a heel region 24. As illustrated in FIGS. 1A, 1B, and 1D, the forefoot region 20 may be further subdivided into a toe portion 20T corresponding with phalanges and a ball portion 20B associated with metatarsal bones of a foot. The mid-foot region 22 may correspond with an arch area of the foot, and the heel region 24 may correspond with rear portions of the foot, including a calcaneus bone.

Upper 101 may include interior surfaces that define an interior void configured to, for example, receive and secure a foot for support on sole structure 100. Upper 101 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, upper 101 may include a strobel (not shown) having a bottom surface opposing sole structure 100 and an opposing top surface defining a footbed of the interior void. Stitching or adhesives may secure the strobel to upper 101. The footbed may be contoured to conform to a profile of the bottom surface (e.g., plantar) of the foot. Upper 101 may also incorporate additional layers such as an insole or sockliner that may be disposed upon the strobel and reside within the interior void of upper 101 to receive a plantar surface of the foot to enhance the comfort of the article of footwear 10. An ankle opening 103 in heel region 24 may provide access to the interior void. For example, the ankle opening 103 may receive a foot to secure the foot within the void and facilitate entry and removal of the foot from and to the interior void.

In some examples, one or more fasteners 105 may extend along the upper 101 to adjust a fit of the interior void around the foot and to accommodate entry and removal of the foot therefrom. The fasteners 105 may include laces, straps, cords, hook-and-loop, or any other suitable type of fastener. The upper 101 may include a tongue portion that extends between the interior void and the fasteners.

Figure 1E:
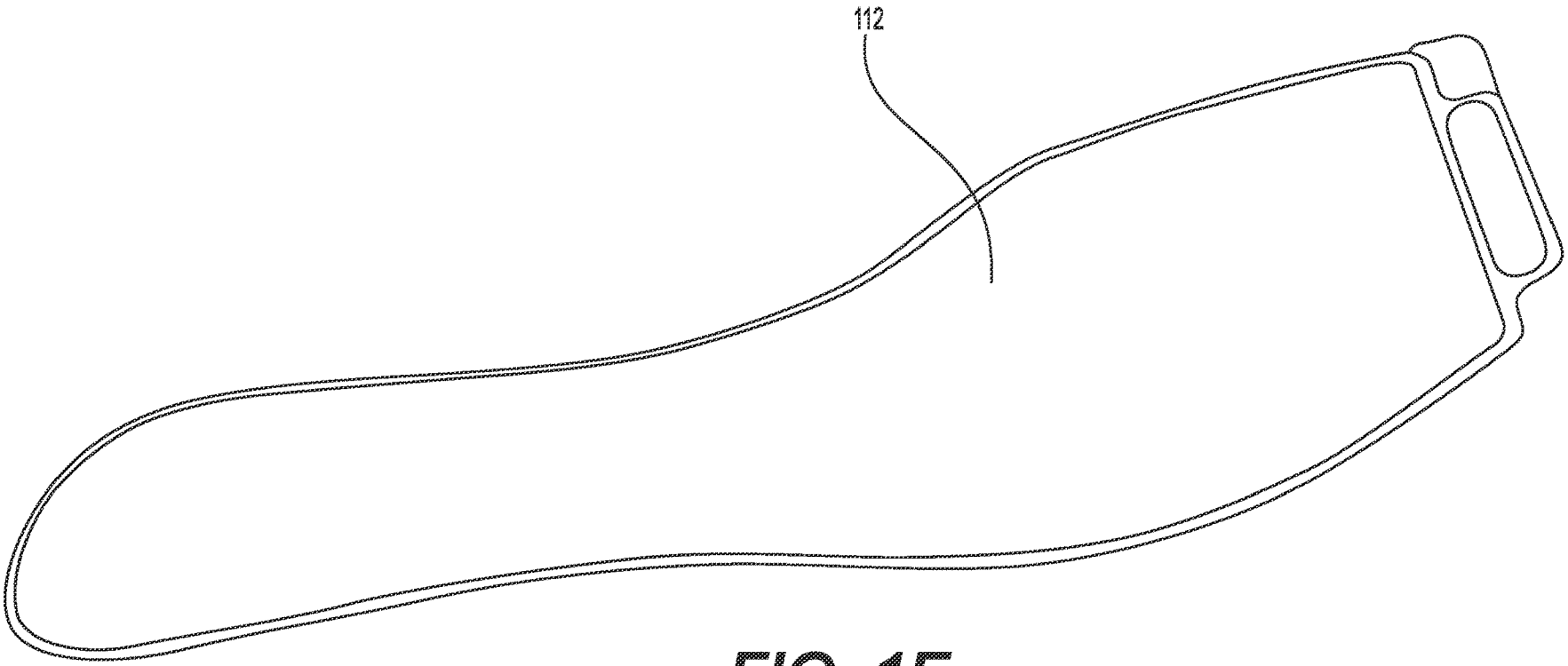
FIG. 1E is a perspective view of a comfort element of the footwear FIG. 1A.

As shown in FIGS. 1A and 1B, sole structure 100 may include stabilizing elements 302A, 302B, and 302C, which are further discussed herein. Comfort element 112, as shown in FIG. 1E also is further discussed herein.

Sole Structure

Figure 2:
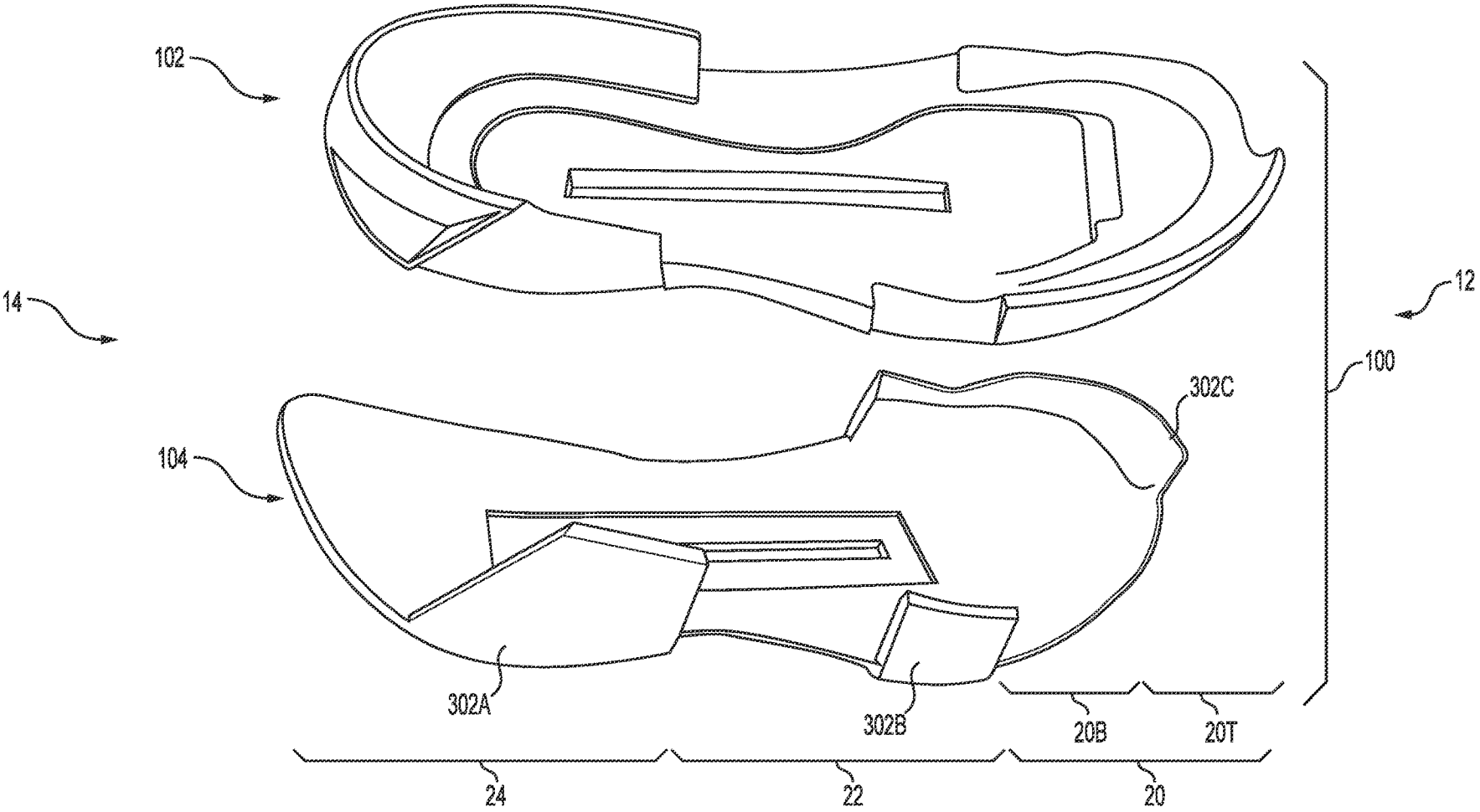
FIG. 2 is an exploded top perspective view of a sole structure of the article of footwear of FIG. 1A.

Referring to FIG. 2, sole structure 100 includes a midsole 102 configured to impart properties of, among other things, cushioning, support, and responsiveness, and an outsole 104 configured to impart properties of, among other things, traction, cushioning, support, responsiveness, and abrasion resistance. Outsole 104 may define a ground engaging surface of the article of footwear 10. Outsole 104 may be shaped to attach to midsole 102, as further discussed herein.

One or more of the midsole 102 or outsole 104 may be formed of a resilient polymeric material, such as foam or rubber, to impart properties of, among other things, cushioning, support, responsiveness, and energy distribution to the foot of the wearer. In the illustrated example, midsole 102 may be formed of a first foam material and outsole 104 may be formed of a second foam material, which may be different from the first foam material. Alternatively, midsole 102 and outsole 104 may be formed of the same foam material. For example, midsole 102 may be formed of a first foam material having a first durometer, and outsole 104 may be formed of a second foam material having a second durometer. Alternatively, midsole 102 and outsole 104 may include a foam material that may have the same durometer. Midsole 102 and outsole 104 may be affixed within the sole structure using a fusing process, using an adhesive, or by suspending the elements in a different resilient polymeric material. As discussed herein, midsole 102 and outsole 104 may be formed with cooperating geometries (e.g., support structures, detents, recesses, protrusions, etc.) for restricting or otherwise inhibiting relative motion between midsole 102 and outsole 104.

Example resilient polymeric materials for midsole 102 and outsole 104 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent, which forms a gas when heated above its activation temperature. For example, the chemical blowing agent may be an azo compound such as adodicarbonamide, sodium bicarbonate, and/or an isocyanate.

In some embodiments, the foamed polymeric material may be a cross-linked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 3A:
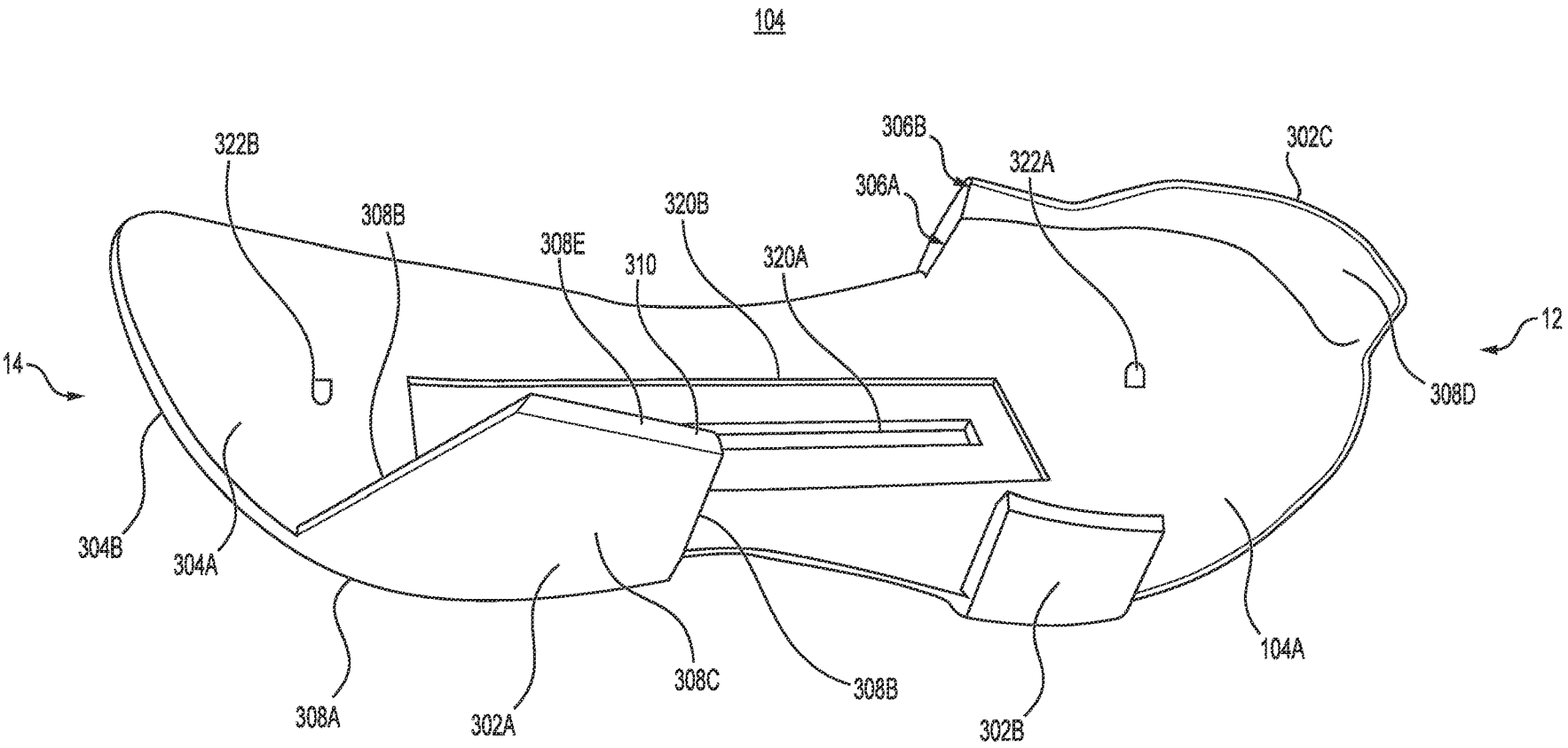
FIG. 3A is a perspective view of an outsole of the article of footwear of FIG. 1A.
Figure 3B:
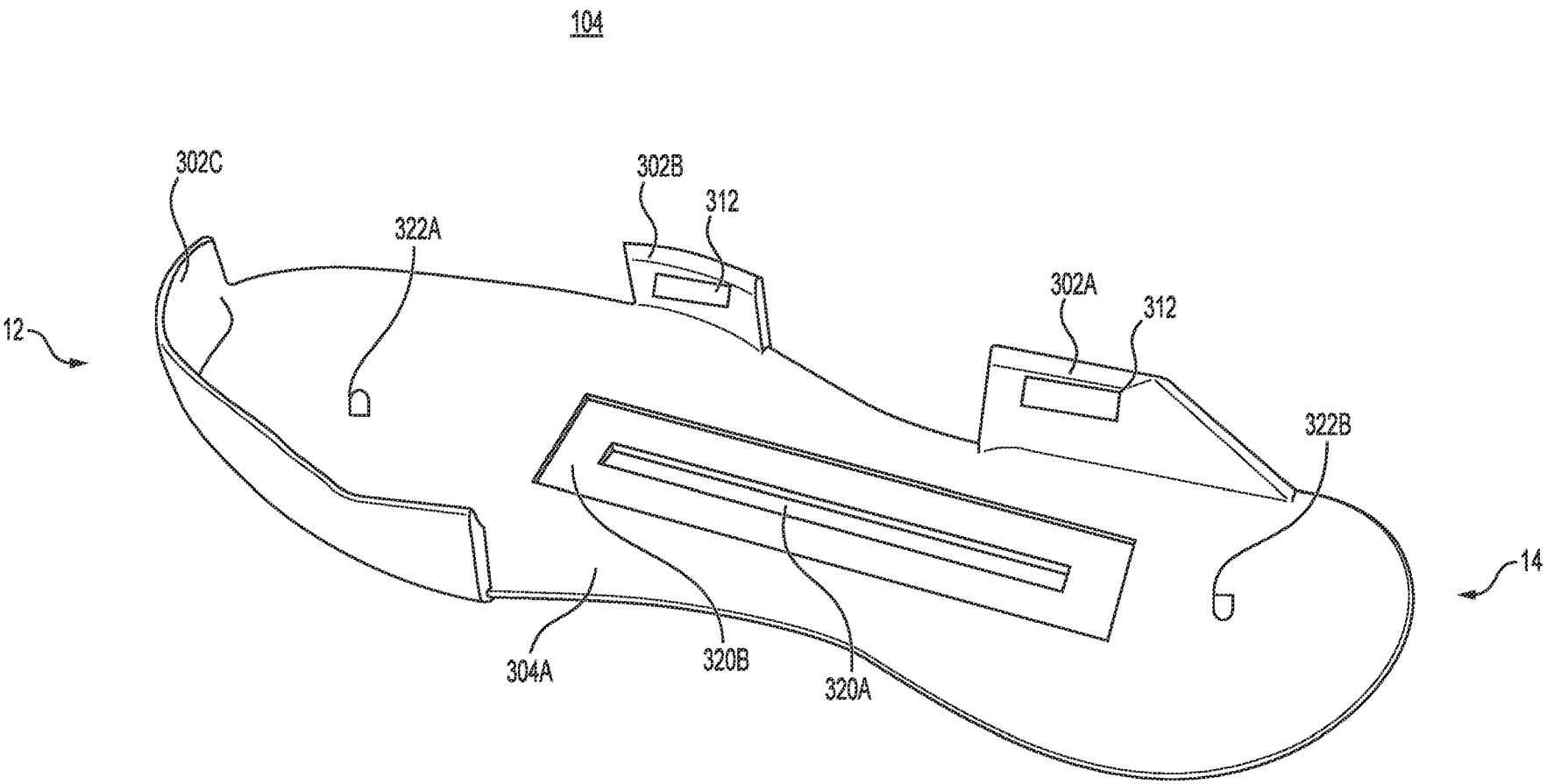
FIG. 3B is another perspective view of the outsole of FIG. 3A.
Figure 3C:
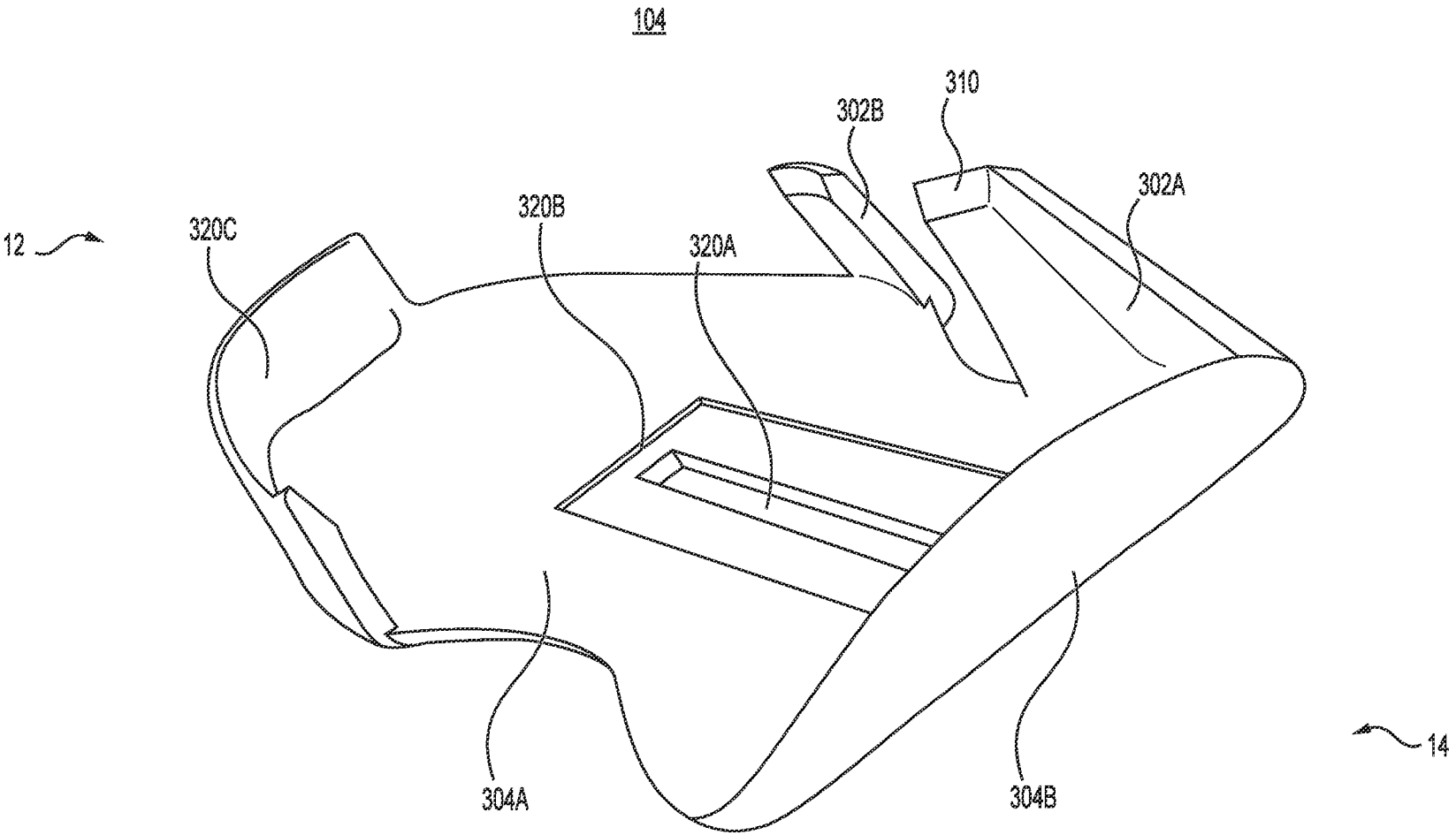
FIG. 3C is another perspective view of the outsole of FIG. 3A.

Referring to FIGS. 3A-3C, outsole 104 may include one or more stabilization elements 302A, 302B, and 302C (generally referred to stabilization elements 302). Stabilization elements 302 may provide directional support (e.g., lateral support) during use of footwear 10. For example, stabilization elements 302 may provide a counterforce to a force applied against stabilization elements 302. Stabilization elements 302 may be shaped to apply a counterforce proportional to an expected force applied against respective stabilization elements 302 (e.g., based on a position of stabilization elements 302). For example, an expected force at heel region 24 or forefront portion 20 may generally be greater than the expected force at mid-foot region 22. Accordingly, the surface area of stabilization elements 302 at heel region 24 or forefront portion 20 may be greater than the surface area of stabilization elements 302 at mid-foot region 22.

When a wearer inserts their foot into footwear 10, the sides of the wearer's foot may push outwardly against the stabilization elements 302. When wearer performs a movement (e.g., walking, running, side-to-side shuffling, rapid direction changes, playing a sport, etc.), their foot may exert respective pressures against one or more stabilization elements 302. Those stabilization elements 302 may provide a proportional counterforce to the exerted respective pressures, thereby stabilizing the wearer's foot.

As shown in FIG. 3A, for example, stabilization elements 302 may include a joining surface 308A joining the stabilization elements 302 to an outsole base 104A. Joining surface 308A may be part of a stabilization elements 302 and/or outsole base 104A such that joining surface 308A, stabilization elements 302, and outsole base 104A are formed of a unitary, integral, or one-piece construction. Stabilization elements 302 may be flexible such that they may flex in a direction towards the interior of outsole 104 and/or away from the interior of outsole 104. Stabilization elements 302 may flex at the joining surface 308A.

Stabilization elements 302 may include an interior surface 308D (shown in reference to stabilization element 302C in FIG. 3A) and an exterior surface 308C (shown in reference to stabilization element 302A in FIG. 3A). Interior surface 308D and/or exterior surface 308C may be smooth, patterned (e.g., a traction pattern), etc. Stabilization elements 302 may include a distal boundary 308E opposite the joining surface 308A (e.g., facing away from outsole base 104A). Stabilization elements 302 may include side boundaries 308B between joining surface 308A and distal boundary 308E. As shown in FIG. 3A, an edge (or edge surface) 310 of stabilization element 302A may be provided at side boundaries 308B and/or distal boundary 308E. Edge 310 may be tapered such that the thickness of stabilization elements 302 at side boundaries 308B and/or distal boundary 308E may be less than the thickness at one or more other portions of stabilization elements 302.

Outsole 104 may include any number of stabilization elements 302 such as, for example, approximately one stabilization element to approximately ten stabilization elements. Stabilization elements 302 may extend away from a bottom surface 304B of outsole base 104A towards upper 101 in a direction from the bottom surface 304B towards the upper surface 304A. Stabilization elements 302 may extend past a portion of upper 101, as shown in FIGS. 1A and 1B.

Stabilization elements 302 may each have the same length measured from outsole base 104A to distal boundary 308E.

Alternatively, stabilization elements 302 may have varying lengths such that a first stabilization element may have a first length measured from outsole base 104A to its respective distal boundary 308E and a second stabilization element may have a second length measured from outsole base 104A to its respective distal boundary 308E. Stabilization elements 302 may have any applicable dimension measured from one boundary surface (e.g., joining surface 308A, side boundaries 308B, distal boundary 308E) to another (e.g., between approximately 2 cm to approximately 100 cm).

Stabilization elements 302 may have a variable thicknesses (e.g., cross-sectional thicknesses). For example, as shown in FIG. 3A, stabilization element 302C may have a first thickness at a first portion 306A of stabilization element 302C and a second thickness at a second portion 306B of stabilization element 302C. As shown, the first thickness at 306A proximate to upper surface 304A of outsole base 104A may be thicker than the second thickness at 306B distal to upper surface 304A. Alternatively, a thickness proximate to upper surface 304A may be thinner than a thickness distal to upper surface 304A. According to another example, a cross-sectional thickness of stabilization elements 302 may change as a gradient from a first thickness to a second thickness. According to another example, the thickness of stabilization elements 302 may form a pattern or may randomly vary across the length of one or more stabilization elements 302. Although variable thicknesses are generally described as varying across a lengthwise direction extending from upper surface 304A to a direction extending away from upper surface 304A (e.g., towards an upper 101), it will be understood that the variable thicknesses may vary across any applicable portions of stabilization elements 302 (e.g., in a direction parallel or substantially parallel to upper surface 304A). Stabilization elements 302A, 302B, and 302C may each have constant and/or varying thicknesses that are the same or that are different than one or more of the other stabilization elements 302A, 302B, and 302C.

Stabilization elements 302 may have any applicable shape such as, but not limited to, a trapezoidal shape, a rounded shape, an angular shape, a rectangular shape, a circular shape, an oval shape, a shape that contours the external surfaces of a foot, or the like. For example, as shown in FIGS. 3A-3C, stabilization element 302A may be substantially trapezoidal, stabilization element 302B may be substantially rectangular, and stabilization element 302C may substantially contour the external surface of a forefront.

Two or more stabilization elements 302 may have the same dimensions while one or more other stabilization elements 302 may have different dimensions than the two or more stabilization elements 302. Similarly, two or more stabilization elements 302 may have the same shape while one or more other stabilization elements 302 may have different shape than the two or more stabilization elements 302.

As shown in FIGS. 1A, 1B, and 3A, stabilization element 302A may span at least a portion of a heel region 24, stabilization element 302B may span at least a portion of mid-foot region 22, and stabilization element 302C may span at least a portion of forefoot region 20 including toe portion 20T and/or ball portion 20B. Although stabilization elements 302A, 302B, and 302C are shown herein, it will be understood that one or more stabilization elements 302 may extend from any applicable portion of outsole 104 including any applicable portion of heel region 24, mid-foot region 22, and/or forefoot region 20. Moreover, although three individual stabilization elements 302 are described herein, those of ordinary skill in the art will understand that outsole 104 may include a greater or lesser number of stabilization elements 302.

Outsole 104 may be molded to include stabilization elements 302 such that stabilization elements 302 are formed from the same material as an outsole base 104A and extend from outsole base 104A. Accordingly, outsole 104 may have a unitary, integral, or one-piece construction such that outsole 104 may be a single component that includes stabilization elements 302. According to an alternative embodiment, stabilization elements 302 may be attached to outsole 104, such as at outsole base 104A. Stabilization elements 302 may be attached to outsole 104 in any suitable manner such as using adhesives or cements, mechanical connectors, or the like.

Figure 4A:
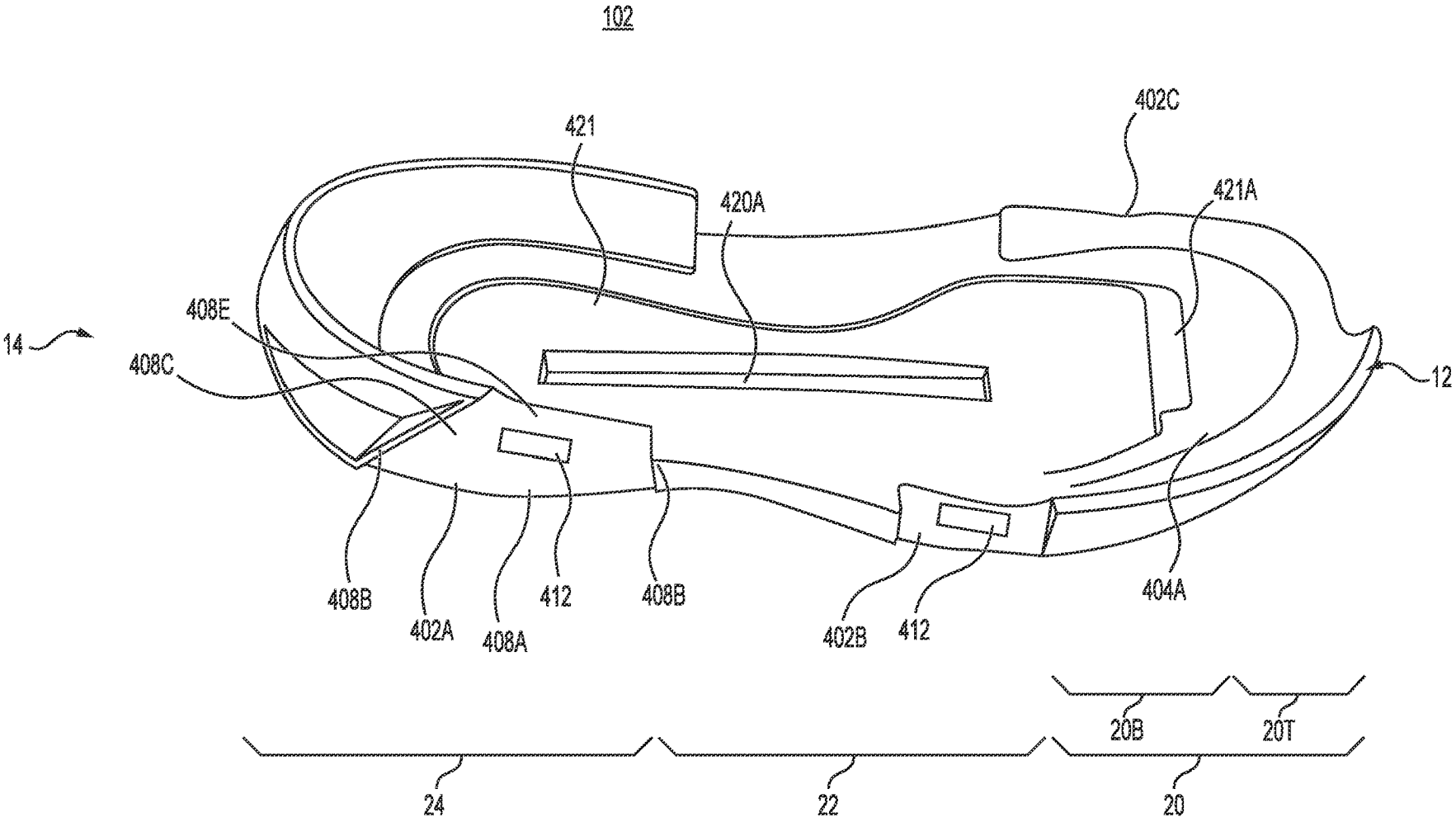
FIG. 4A is a perspective view of a midsole of the article of footwear of FIG. 1A.

Stabilization elements 302 may include mating geometric features such as, e.g., indent 312 (shown in at least FIG. 3B) at interior surface 308D. Indent 312 may be configured to receive a corresponding mating geometric feature of midsole 102, such as, e.g., protrusion 412 (as shown in FIG. 4A), as further discussed herein. Indent 312 may be shaped to include a recess that receives protrusion 412. Indent 312 may mate with protrusion 412 to engage midsole 102 with outsole 104. The mating may provide a counterforce mitigating and/or preventing separation of midsole from outsole 104. Indent 312 at a first stabilization element may be the same shape and/or size as indent 312 at a second stabilization element. Alternatively, different stabilization elements have different sized or shaped indents 312. For example, indent 312 at a given stabilization element may be proportional to the size to that stabilization element.

As shown in FIGS. 3A-3C, outsole 104 may include an opening 320A. Opening 320A may extend along a center longitudinal axis of outsole 104, as shown. Alternatively, opening 320A may extend across any applicable portion of outsole 104 such as offset from the center longitudinal axis, proximate to interior end 12, proximate to posterior end 14, proximate to forefoot region 20, proximate to mid-foot region 22, proximate to heel region 24, etc. Opening 320A may extend from bottom surface 304B through upper surface 304A of outsole 104. Opening 320A may be any applicable shape such as, but not limited to, rectangular (as shown), a trapezoidal shape, a rounded shape, an angular shape, a circular shape, an oval shape, or the like. Opening 320A may have one or more dimensions ranging from approximately 2 cm to approximately 80 cm. Opening 320A of outsole 104 may match with an opening 420 (as shown in FIG. 4A) of midsole 102 such that a continuous opening is formed extending from outsole 104 to midsole 102.

Figure 4B:
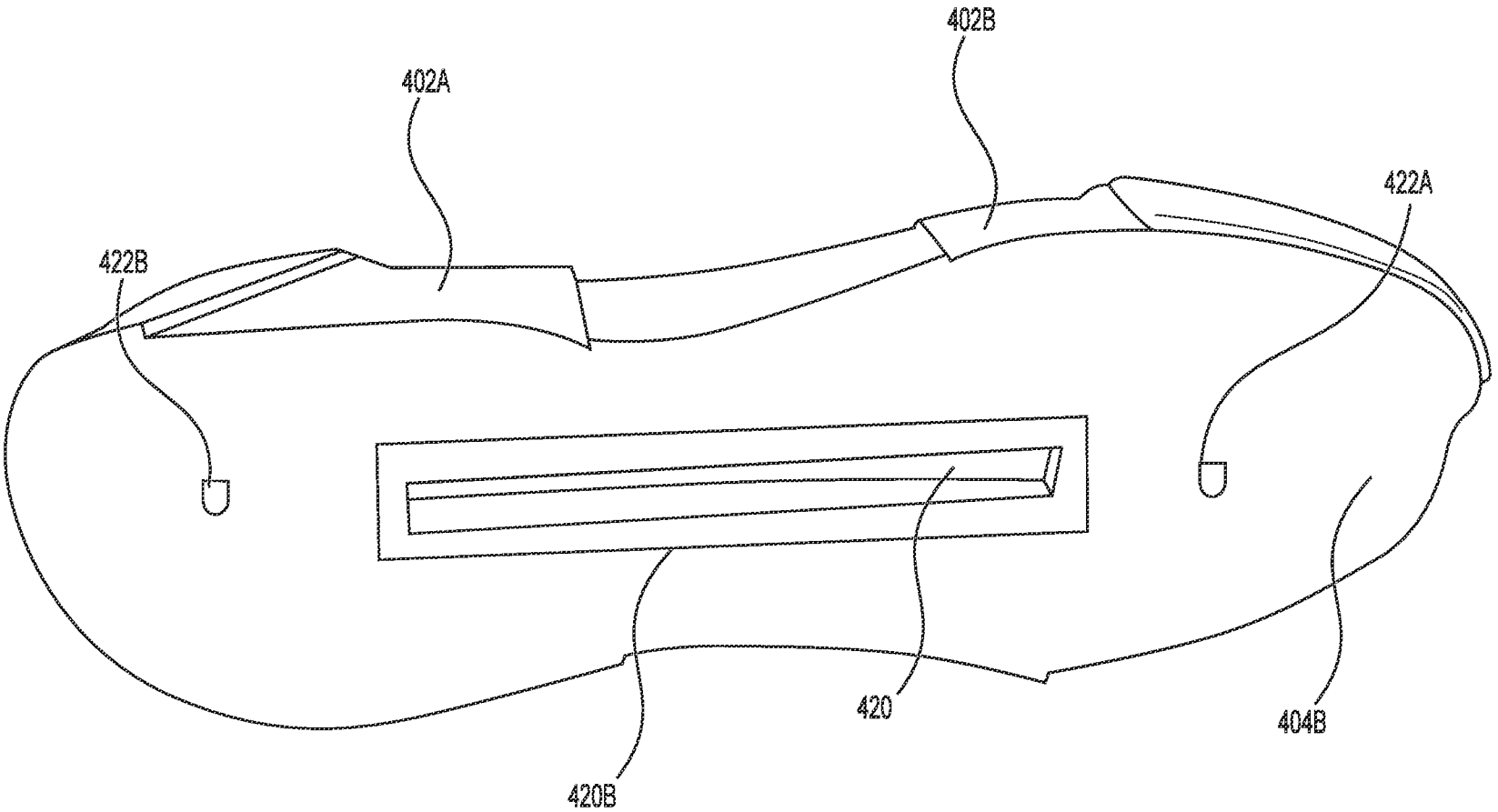
FIG. 4B is another perspective view of the midsole of FIG. 4A.

As shown in FIGS. 3A-3C, outsole 104 may include a recess 320B that fully or partially surrounds opening 320A. The thickness of outsole 104 within recess 320B may be less than the thickness of outsole 104 outside recess 320B. Opening 320A may be provided within recess 320B. Accordingly, recess 320B may create a boundary around opening 320A, as shown, and recess 320B may have a shape substantially similar to opening 320A. The boundary created by recess 320B around opening 320A may be approximately 1 cm to approximately 30 cm. The boundary created by recess 320B around opening 320A may be the same width from all edges of the recess 320B to a corresponding closest edge of opening 320A. Alternatively, the boundary created by recess 320B around opening 320A may have varying widths from edges of the recess 320B to a corresponding closest edge of opening 320A. Recess 320B may pair with an indent 420B (as shown in FIG. 4B) of midsole 102 such that recess 320B of outsole 104 mates with indent 420B of midsole 102.

As shown in FIGS. 3A and 3B, outsole 104 may include one or more geometric features, such as, e.g., protrusions 322A. Protrusions 322A may extend from upper surface 304A towards midsole 102. Protrusions 322A may pair with corresponding geometric features of midsole 102, e.g., recesses 422A of midsole 102 (as shown in FIG. 4B) to engage midsole 102 with outsole 104. The mating may provide a holding force mitigating and/or preventing separation of midsole from outsole 104.

As shown in FIGS. 3A and 3B, outsole 104 may include one or more geometric features, such as, e.g., recesses 322B. Recesses 322B may extend from upper surface 304A and away from midsole 102. Recesses 322B may pair with corresponding geometric features of midsole 102, e.g., protrusions 422B of midsole 102 (as shown in FIG. 4B) to engage midsole 102 with outsole 104. The mating may provide a holding force mitigating and/or preventing separation of midsole from outsole 104.

Bottom surface 304B may include a pattern (e.g., a design, a traction pattern, etc.). The pattern may provide abrasion-resistance and traction with the ground surface. The pattern may be a random pattern, may be optimized for traction, or the like. In some embodiments, a bottom surface 304B pattern may continue along exterior surface 308C of stabilization elements 302.

Figure 3D:
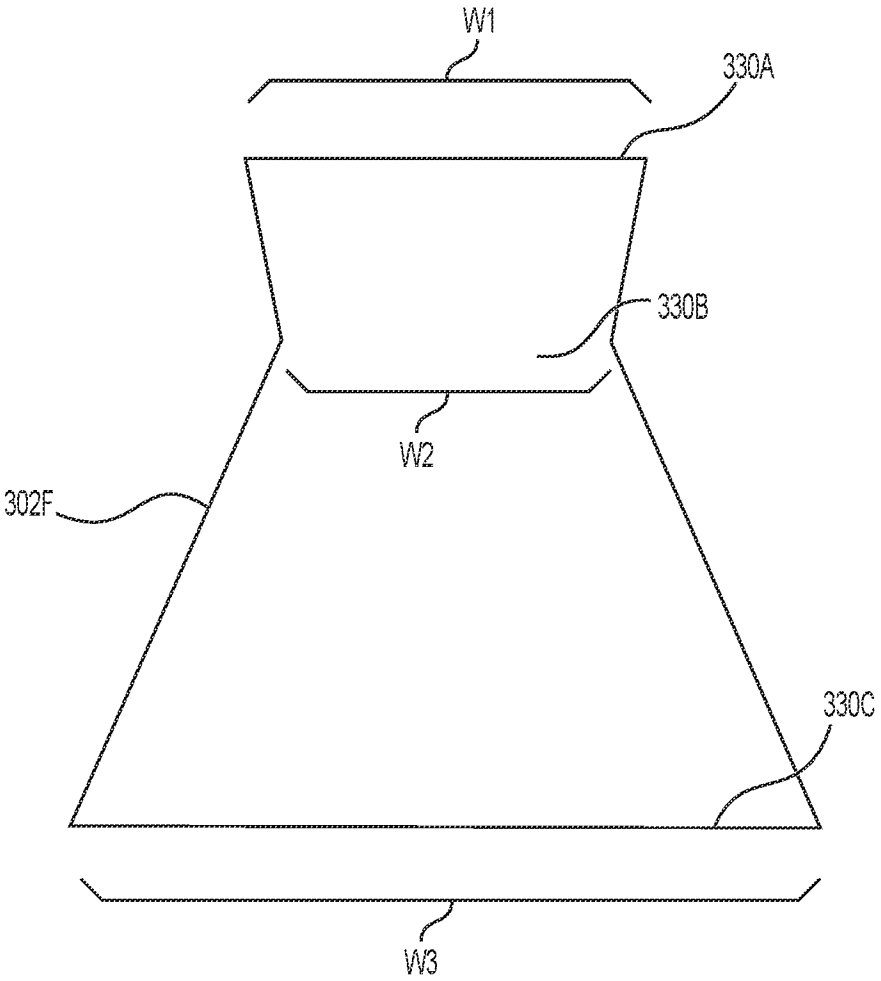
FIG. 3D is schematic diagram of a stabilization element of the outsole of FIG. 3A.

FIG. 3D shows another example stabilization element 302F. Stabilization element 302F may have a first section 330C at a joining surface 308A, a second section 330A opposite the first section 330C at distal boundary 308E, and a middle section 330B between first section 330C and second section 330A. Middle section 330B may have a width W2 that is less than width W1 of second section 330A. Width W2 may also be less than width W3 of first section 330C or may be the same as or greater than width W3. Stabilization element 302F is further discussed herein in reference to midsole 102.

Referring to FIGS. 4A-4B, midsole 102 may include an upper surface 404A and a bottom surface 404B. Bottom surface 404B may mate with outsole 104 such that bottom surface 404B is attached to upper surface 304A of outsole 104. Upper surface 404A may include one or more layers such that portions of upper surface 404A extend past other portions of upper surface 404A, as shown in FIG. 4A. Midsole 102 may include one or more geometric features such as, e.g., detents 402A, 402B, and 402C (generally referred to as detents 402). Detents 402 may be paired with stabilization elements 302 of outsole 104 such that detents 402 may be shaped to mate with (e.g., receive) corresponding stabilization elements 302. For example, detent 402A may be shaped to receive stabilization element 302A, detent 402B may be shaped to receive stabilization element 302B, and detent 402C may be shaped to receive stabilization element 302C.

Accordingly, detents 402 may have any suitable shape configured to receive corresponding stabilization elements 302 such as, but not limited to, a trapezoidal shape, a rounded shape, an angular shape, a rectangular shape, a circular shape, an oval shape, a shape that contours the external surfaces of a foot, or the like. For example, as shown in FIG. 4A, detent 402A may be substantially trapezoidal in configuration, detent 402B may be substantially rectangular in configuration, and detent 402C may substantially contour the external surface of a forefront.

Two or more detents 402 may have the same dimensions while one or more other detents 402 may have different dimensions than the two or more detents 402. Similarly, two or more detents 402 may have the same shape while one or more other detents 402 may have different shape than the two or more detents 402.

As shown in FIG. 4A, in reference to detent 402A, detents 402 may include a bottom edge 408A that forms an edge with bottom surface 404B of midsole 102. Detents 402 may include an exterior surface 408C, shown in reference to detent 402A. Exterior surface 408C may be smooth, patterned, etc. Detents 402 may include a distal edge 408E opposite the bottom edge 408A (e.g., facing away from bottom surface 404B and flush with upper surface 404A). Detents 402 may include side boundaries 408B between bottom edge 408A and distal edge 408E.

Stabilization elements 302 may mate with detents 402 such that joining surface 308A of stabilization elements 302 contacts or is proximate to bottom edge 408A of detents 402. Side boundaries 408B of detents 402 may contact or be proximate to side boundaries 308B of stabilization elements 302. Distal edge 408E of detents 402 may contact or be proximate to distal boundary 308E of stabilization elements 302. Alternatively, distal edge 408E of detents 402 may contact or be proximate to interior surface 308D of stabilization elements 302 such that distal boundary 308E of stabilization elements 302 extends past distal edge 408E of detents 402, towards upper 101. Although detents 402 are described as having a bottom edge 408A, side boundaries 408B, and distal edge 408E, it will be understood that detents 402 may have any applicable shape that corresponds to respective stabilization elements 302.

All or a portion of interior surface 308D of stabilization elements 302 may be attached to, contact, and/or be proximate to exterior surface 408C of detents 402. Detents 402 may be attached or otherwise secured to corresponding stabilization elements 302 in any suitable manner such as using adhesives or cements, mechanical connectors, or the like. Detents 402 may be attached to corresponding stabilization elements 302 such that at least portions of stabilization elements 302 are securely contained within detents 402. Accordingly, the shape created by detents 402 may be slightly larger than corresponding stabilization elements 302 (e.g., less than approximately 1% larger, less than approximately 3% larger, less than approximately 10% larger, etc.). For example, the dimensions of the shape created by bottom edge 408A, side boundaries 408B, and distal edge 408E of detents 402 may be slightly larger than the dimensions of the shape created by joining surface 308A, side boundaries 308B, and distal boundary 308E of corresponding stabilization elements 302.

Midsole 102 may include any number of detents 402 such as approximately one detent to approximately ten detents. The number of detents 402 of midsole 102 may correspond to the number of stabilization elements 302 of outsole 104.

Detents 402 may each have the same length measured from bottom edge 408A to distal edge 408E. Alternatively, detents 402 may have varying lengths such that a first detent may have a first length measured from its respective bottom edge 408A to its respective distal edge 408E and a second detent may have a second length measured from its respective bottom edge 408A to its respective distal edge 408E.

Detents 402 may have a variable depth. For example, detent 402A may have a first depth at a first distal boundary 408B of detent 402A proximate to posterior end 14 and a second depth at a second distal boundary 408B of the same detent 402A proximate to anterior end 12. The first depth at the first distal boundary 408B proximate to posterior end 14 may be deeper than the second depth at the second distal boundary 408B proximate to anterior end 12. The depth of a portion of detents 402 may correspond to the thickness of a corresponding portion of corresponding stabilization elements 302 that pair with detents 402. Although variable depths are generally described as varying across a lengthwise direction extending from upper surface 404A to a direction extending away from upper surface 404A (e.g., towards an upper 101), it will be understood that the variable depths may vary across any applicable portions of detents 402 (e.g., in a direction parallel or substantially parallel to upper surface 404A). Detents 402A, 402B, and 402C may each have constant and/or varying depths that are the same or that are different than one or more of the other detents 402A, 402B, and 402C.

As shown in 4A, detent 402A may span at least a portion of a heel region 24, detent 402B, may span at least a portion of mid-foot region 22, and detent 402C may span at least a portion of forefoot region 20 including toe portion 20T and/or ball portion 20B. Although, detents 402A, 402B, and 402C are shown herein, it will be understood that one or more detents 402 may extend from any applicable portion of midsole 102 including any applicable portion of heel region 24, mid-foot region 22, and/or forefoot region 20.

Midsole 102 may be molded to include detents 402 such that detents 402 are molded or cut out from the material of midsole 102. Accordingly, midsole 102 may be a unitary, integral, or one-piece construction that includes detents 402.

Detents 402 may include geometric features such as, e.g., a protrusion 412 on exterior surface 408C. Protrusion 412 may be shaped to mate with a corresponding geometric features such as, e.g., indent 312 (as shown in FIG. 3A) of outsole 104. Protrusion 412 may be shaped to include a bump shaped to be inserted into a corresponding recess of indent 312. Indent 312 may mate with protrusion 412 to engage midsole 102 with outsole 104. The mating may provide a counterforce mitigating and/or preventing separation of midsole from outsole 104. Protrusion 412 may be the same shape and/or size for one or more detents 402. Alternatively, protrusion 412 may be a different size or shape for different detents. For example, protrusion 412 for a given detent may be proportional in size to that given detent and/or may be proportional in size to the corresponding indent 312 of corresponding stabilization elements 302. Although stabilization elements 302 are described as having an indent 312 and detents 402 are described as having protrusion 412, it will be understood that stabilization elements 302 may include any applicable geometric features such as, e.g., a protrusion and detents 402 may include corresponding geometric features such as, e.g., an indent, such that a geometric feature of either stabilization elements 302 or detents 402 pairs with a corresponding geometric feature of the other.

As shown in FIGS. 4A-4B, midsole 102 may include an opening 420A. Opening 420A may extend along a center longitudinal axis of midsole 102, as shown. Alternatively, opening 420A may extend across any applicable portion of midsole 102 such as offset from the center longitudinal axis, proximate to interior end 12, proximate to posterior end 14, proximate to forefoot region 20, proximate to mid-foot region 22, proximate to heel region 24, etc. Opening 420A may extend from bottom surface 404B through upper surface 404A of midsole 102. Opening 420 may be any applicable shape such as, but not limited to, rectangular (as shown), a trapezoidal shape, a rounded shape, an angular shape, a circular shape, an oval shape, or the like. Opening 420 may have one or more dimensions ranging from approximately 2 cm to approximately 80 cm. Opening 420 may align with opening 320A (as shown in FIG. 3A) of outsole 104 such that a continuous opening across both outsole 104 and midsole 102 is formed.

As shown in FIG. 4A, midsole 102 may include a recess 421 that includes opening 420A. The thickness of midsole 102 at recess 421 may be less than the thickness of midsole 102 outside recess 421. All or a portion of opening 420A may be provided within recess 421. Accordingly, recess 421 may create a boundary around opening 420A, as shown, and recess 421 may have a shape substantially similar to opening 420A. The boundary created by recess 421 around opening 420 may be approximately 1 cm to approximately 30 cm. The boundary created by recess 421 around opening 420 may be the same width from all edges of the recess 421 to a corresponding closest edge of opening 420A. Alternatively, the boundary created by recess 421 around opening 420A may have varying widths from edges of the recess 421 to corresponding closest edges of opening 420A. In some embodiments, recess 421 may be nested within one or more other recesses such as secondary recess 421A, shown in FIG. 4A. All or a portion of recess 421 may be provided within secondary recess 421A. The thickness of midsole 102 at secondary recess 421A may be less than the thickness of midsole 102 outside secondary recess 421A and may be greater than the thickness at recess 421. Secondary recess 421A may create a boundary around recess 421, as shown, and secondary recess 421A may have a shape substantially similar to recess 421. The boundary created by secondary recess 421A around recess 421 may be approximately 1 cm to approximately 30 cm. The boundary created by secondary recess 421A around recess 421 may be the same width from all edges of the secondary recess 421A to a corresponding closest edge of recess 421. Alternatively, the boundary created by secondary recess 421A around recess 421 may have varying widths from edges of secondary recess 421A to corresponding closest edges of recess 421.

A comfort element 112 (as shown in FIGS. 1D and 1E) may be a soft material, an airbag, a fluid bag, or the like and may be positioned on the upper surface 404A of midsole 102 and/or between midsole 102 and outsole 104. Comfort element 112 may be attached to upper surface 404A of midsole 102 or upper surface 304A of outsole 104. Comfort element 112 may be visible through opening 320A of outsole 104 and may also be visible through opening 420A of midsole 102. For example, when viewing footwear 10 from a bottom view (e.g., as shown in FIG. 1D), comfort element 112 may be visible via opening 320A of outsole 104 and may further be visible through opening 420A of midsole 102 may be visible.

As show in FIG. 4B, midsole 102 may include one or more geometric features such as, e.g., indent 420B on bottom surface 404B. Recess 320B of outsole 104 (as shown in FIG. 3A) may pair with corresponding geometric features of midsole 102 such as, e.g., indent 420B such that recess 320B of outsole 104 receives indent 420B of midsole 102.

As also shown in FIG. 4B, midsole 102 may include one or more geometric features such as, e.g., recesses 422A. Recesses 422A may extend within bottom surface 404B away from outsole 104. Protrusions 322A of outsole 104 (as shown in FIG. 3A) may pair with geometric features of midsole 102 such as, e.g., recesses 422A to engage midsole 102 with outsole 104. The mating may provide a holding force mitigating and/or preventing separation of midsole from outsole 104.

With continuing reference to FIG. 4B, midsole 102 may include one or more geometric features, such as, e.g., protrusions 422B. Protrusions 422B may extend from bottom surface 404B and toward outsole 104. Recesses 322B of outsole 104 (as shown in FIG. 3A) may pair with protrusions 422B of midsole 102 to engage midsole 102 with outsole 104. The mating may provide a holding force mitigating and/or preventing separation of midsole from outsole 104.

Figure 4C:
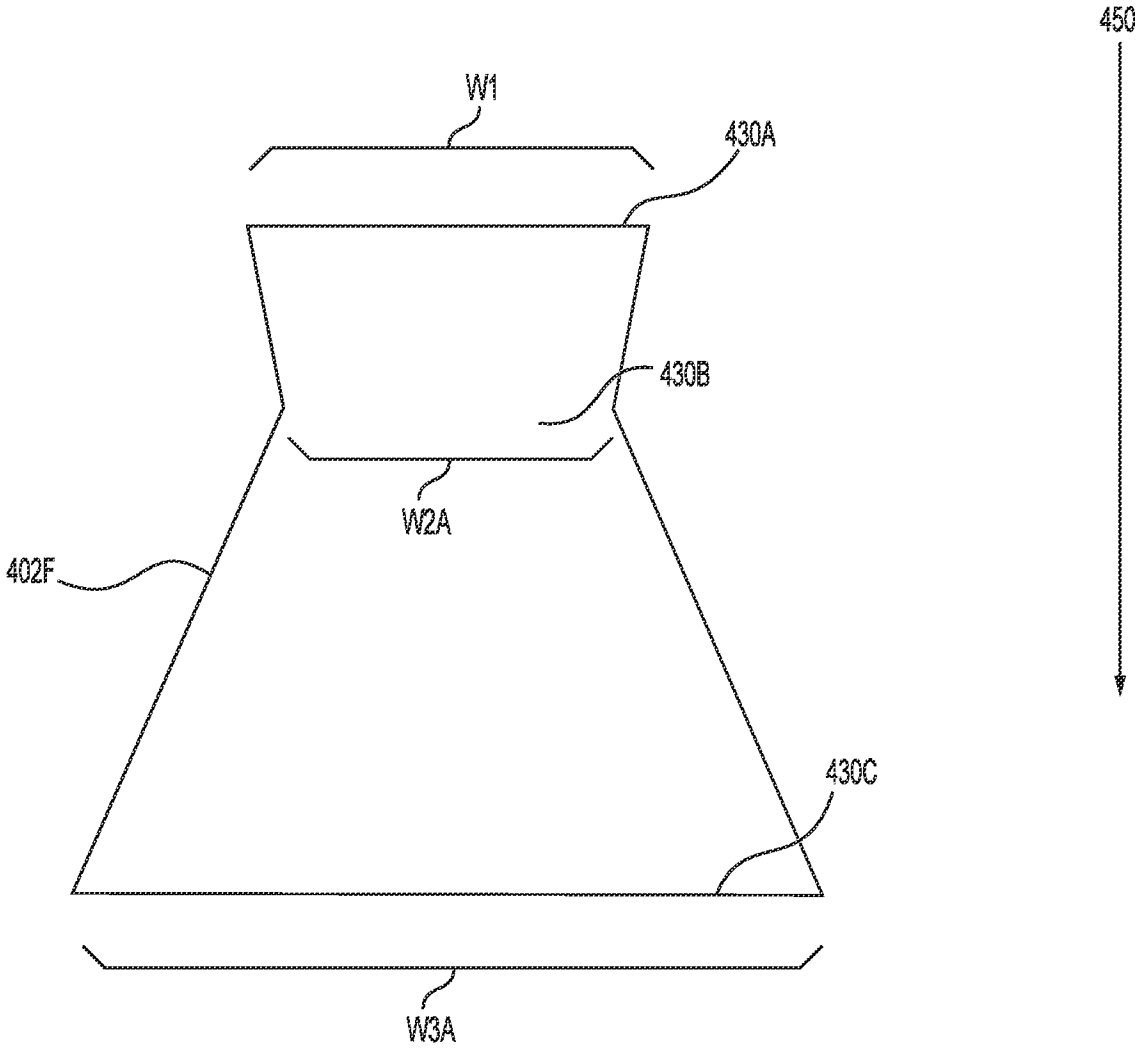
FIG. 4C is schematic diagram of a detent of the midsole of FIG. 4A.

FIG. 4C shows an example detent 402F. Detent 402F may have a first section 430C at a bottom edge 408A, a second section 430A opposite the first section 430C at distal edge 408E, and a middle section 430B between first section 430C and second section 430A. Middle section 430B may have a width W2A that is less than width W1A of second section 430A. Width W2A may also be less than width W3A of first section 430C or may be the same as or greater than width W3A.

Stabilization element 302F of outsole 104 may pair with detent 402F of midsole 102 (e.g., stabilization element 302F may be positioned between side boundaries of detent 402F). For example, stabilization element 302F may be force fit into detent 402F. First section 430C of detent 402F may receive first section 330C of stabilization element 302F. Second section 430A of detent 402F may receive second first section 330A of stabilization element 302F. Middle section 430B of detent 402F may receive middle section 330B of stabilization element 302F.

By widths W2 and W2A being less than widths W1 and W1A, detent 402F may exert a counterforce on stabilization element 302F in response to a force pushing stabilization element 302F in direction 450. For example, the foot of a wearer of footwear 10 may exert a force (e.g., a vertical force, a lateral force, an angular force, etc.) at least partially in direction 450 during use of footwear 10 (e.g., during stop or start motion during activity). Based on width W1 and W1A being greater than width W2 and W2A, second section 430A may provide a counter force on stabilization element 302F, in response to the force exerted in direction 450. Accordingly, the shape of detent 402F and stabilization element 302F may prevent or mitigate potential separation or movement of stabilization element 302F from detent 402F.

Figure 5D:
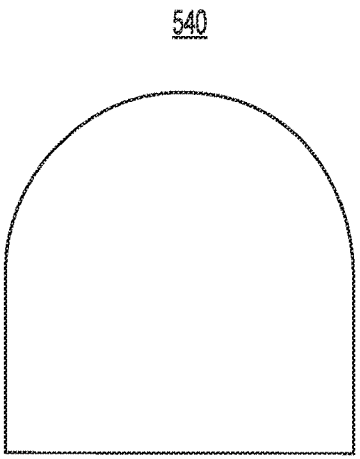
FIGS. 5A-5D show schematic diagrams of various stabilization elements of the outsole of FIG. 3A.
Figure 5C:
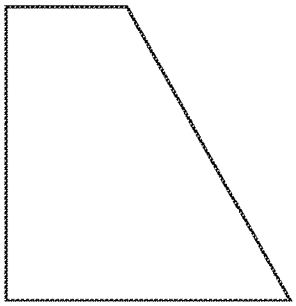
Figure 5B:
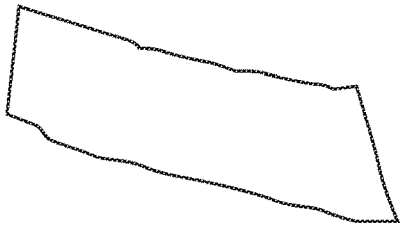
Figure 5A:
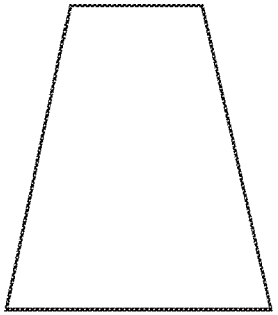

FIGS. 5A-5D show additional schematic diagrams of various stabilization elements of outsole 104. FIG. 5A shows a trapezoidal stabilization element 510. FIG. 5B shows an irregular shaped stabilization element 520. FIG. 5C shows a stabilization element 530 having a first surface at a right angle with a joining surface and a second surface at an acute angle with the joining surface. FIG. 5D shows a dome shaped stabilization element 540.

The following clauses provide an exemplary configuration for an article of footwear and sole structure described above.

Clause 1. An outsole, comprising: a forefoot region; a mid-foot region; a heel region; an outsole base having an upper surface and a bottom surface; a first stabilization element extending from the outsole base past the upper surface, in a direction from the bottom surface towards the upper surface; and a second stabilization element extending from the outsole base past the upper surface, in the direction from the bottom surface towards the upper surface.

Clause 2. The outsole of Clause 1, wherein the first stabilization element has a first joining surface at the outsole base, a first distal boundary opposite the first joining surface, and a first side boundary connecting the first joining surface and the first distal boundary, the first stabilization element having a first length from the first joining surface and the first distal boundary.

Clause 3. The outsole of Clause 1, wherein the first stabilization element is located at a first one of the forefoot region, the mid-foot region, or the heel region and the second stabilization element is located at a different one of the forefoot region, the mid-foot region, or the heel region than the first stabilization element.

Clause 4. The outsole of Clause 1, wherein the first stabilization element spans at least two of the forefoot region, the mid-foot region, and the heel region.

Clause 5. The outsole of Clause 1, wherein the first stabilization element includes a first section having a first thickness and a second section having a second thickness.

Clause 6. The outsole of Clause 1, further comprising at least one of a protrusion or an indent.

Clause 7. The outsole of Clause 1, further comprising an opening extending from the bottom surface to the upper surface.

Clause 8. The outsole of Clause 1, wherein the bottom surface has a pattern configured to provide traction in response to a force applied against the bottom surface.

Clause 9. The outsole of Clause 1, wherein a shape of the first stabilization element is one of a trapezoidal shape, a rounded shape, an angular shape, a rectangular shape, a circular shape, an oval shape, or a shape that contours an external surface of a foot.

Clause 10. An article of footwear comprising: the outsole of Clause 1; and an upper coupled to the outsole.

Clause 11. A sole structure, comprising: an outsole including an outsole base, a first stabilization element extending from the outsole base, and a second stabilization element extending from the outsole base; and a midsole including a first detent shaped to mate with the first stabilization element and a second detent shaped to mate with the second stabilization element.

Clause 12. The sole structure of Clause 11, wherein the first detent has a first detent side boundary and a second detent side boundary, and wherein the first stabilization element is positioned between the first detent side boundary and the second detent side boundary.

Clause 13. The sole structure of Clause 11, further comprising a forefoot region, a mid-foot region, and a heel region, and wherein the first stabilization element is located at a first one of the forefoot region, the mid-foot region, or the heel region and the second stabilization element is located at a second one of the forefoot region, the mid-foot region, or the heel region.

Clause 14. The sole structure of Clause 11, further comprising a forefoot region, a mid-foot region, or a heel region, and wherein the first stabilization element spans at least two of the forefoot region, the mid-foot region, or the heel region.

Clause 15. The sole structure of Clause 11, wherein the first stabilization element has first dimensions and the second stabilization element has second dimensions different than the first dimensions.

Clause 16. The sole structure of Clause 11, wherein the first stabilization element includes a first section having a first thickness and a second section having a second thickness.

Clause 17. The sole structure of Clause 11, wherein the first detent includes a first section having a first depth and a second section having a second depth.

Clause 18. The sole structure of Clause 11, wherein at least one of the outsole or the midsole is of one of unitary, integral, or one-piece construction.

Clause 19. The sole structure of Clause 11, wherein the outsole includes one of a protrusion or a recess and the midsole includes a corresponding other one of the protrusion or the recess.

Clause 20. An article of footwear comprising: the sole structure of Clause 11; and an upper coupled to the sole structure.

We claim:

1. An outsole, comprising:

a forefoot region;

a mid-foot region;

a heel region;

an outsole base having an upper surface and a bottom surface;

a first stabilization element extending from the outsole base past the upper surface, in a direction from the bottom surface towards the upper surface, wherein the first stabilization element includes a first indent within a first interior surface of the first stabilization element; and a second stabilization element extending from the outsole base past the upper surface, in the direction from the bottom surface towards the upper surface, wherein the second stabilization element includes a second indent within a second interior surface of the second stabilization element.

2. The outsole of claim 1, wherein the first stabilization element has a first joining surface at the outsole base, a first distal boundary opposite the first joining surface, and a first side boundary connecting the first joining surface and the first distal boundary, the first stabilization element having a first length from the first joining surface and the first distal boundary.

3. The outsole of claim 1, wherein the first stabilization element is located at a first one of the forefoot region, the mid-foot region, or the heel region and the second stabilization element is located at a different one of the forefoot region, the mid-foot region, or the heel region than the first stabilization element.

4. The outsole of claim 1, wherein the first stabilization element spans at least two of the forefoot region, the mid-foot region, and the heel region.

5. The outsole of claim 1, wherein the first stabilization element includes a first section having a first thickness and a second section having a second thickness.

6. The outsole of claim 1, further comprising at least one protrusion.

7. The outsole of claim 1, further comprising an opening extending from the bottom surface to the upper surface.

8. The outsole of claim 1, wherein the bottom surface has a pattern configured to provide traction in response to a force applied against the bottom surface.

9. The outsole of claim 1, wherein a shape of the first stabilization element is one of a trapezoidal shape, a rounded shape, an angular shape, a rectangular shape, a circular shape, an oval shape, or a shape that contours an external surface of a foot.

10. An article of footwear comprising:

the outsole of claim 1; and an upper coupled to the outsole.

11. A sole structure, comprising:

an outsole including an outsole base, a first stabilization element extending from the outsole base, and a second stabilization element extending from the outsole base, wherein the first stabilization element includes a first indent within a first interior surface of the first stabilization element and the second stabilization element includes a second indent within a second interior surface of the second stabilization element; and a midsole including a first detent shaped to mate with the first stabilization element and a second detent shaped to mate with the second stabilization element, wherein the first detent includes a first protrusion configured to mate with the first indent of the first stabilization element and the second detent includes a second protrusion configured to mate with the second indent of the second stabilization element.

12. The sole structure of claim 11, wherein the first detent has a first detent side boundary and a second detent side boundary, and wherein the first stabilization element is positioned between the first detent side boundary and the second detent side boundary.

13. The sole structure of claim 11, further comprising a forefoot region, a mid-foot region, and a heel region, and wherein the first stabilization element is located at a first one of the forefoot region, the mid-foot region, or the heel region and the second stabilization element is located at a second one of the forefoot region, the mid-foot region, or the heel region.

14. The sole structure of claim 11, further comprising a forefoot region, a mid-foot region, or a heel region, and wherein the first stabilization element spans at least two of the forefoot region, the mid-foot region, or the heel region.

15. The sole structure of claim 11, wherein the first stabilization element has first dimensions and the second stabilization element has second dimensions different than the first dimensions.

16. The sole structure of claim 11, wherein the first stabilization element includes a first section having a first thickness and a second section having a second thickness that is different than the first thickness.

17. The sole structure of claim 11, wherein the first detent includes a first section having a first depth and a second section having a second depth that is different than the first depth.

18. The sole structure of claim 11, wherein at least one of the outsole or the midsole is of one of unitary, integral, or one-piece construction.

19. The sole structure of claim 11, wherein the outsole includes an outsole protrusion and the midsole includes a corresponding midsole recess.

20. An article of footwear comprising:

the sole structure of claim 11; and an upper coupled to the sole structure.

* * * * *